235-379 SR
5/7/85 OR 4,516,015

United States Patent [19]

Uchida, deceased et al.

[11] Patent Number: 4,516,015

[45] Date of Patent: May 7, 1985

[54] AUTOMATIC MONEY RECEIVING AND DISBURSING MACHINE

[75] Inventors: Isamu Uchida, deceased, late of Chigasaki, Japan, by Kazuko Uchida and Chigusa Fujii, heiresses; Eiichi Kokubo, Tokyo, Japan; Kyoichi Osako, Tokyo, Japan; Makoto Yamazaki, Tokyo, Japan; Shinichi Imura, Tokyo, Japan; Junichi Arikawa, Tokyo, Japan; Kowichi Goi, Tokyo, Japan; Hiroshi Hongou, Tokyo, Japan; Takashi Shinozaki, Tokyo, Japan; Hiroshi Emori, Tokyo, Japan

[73] Assignee: Laurel Bank Machine Co., Ltd., Tokyo, Japan

[21] Appl. No.: 388,984

[22] Filed: Jun. 16, 1982

[30] Foreign Application Priority Data

Jun. 16, 1981 [JP] Japan ..... 56-92541

[51] Int. Cl.[3] ..... G07D 11/06

[52] U.S. Cl. ..... 235/379; 235/375; 194/DIG. 26

[58] Field of Search ..... 194/DIG. 26; 414/33; 235/379, 380, 381, 375

[56] References Cited

U.S. PATENT DOCUMENTS

| | | | |
|---|---|---|---|
| 4,116,945 | 9/1979 | Inoyama et al. | 235/379 |
| 4,253,016 | 2/1981 | Hirose | 235/381 |
| 4,364,584 | 12/1982 | Kokubo | 414/33 |
| 4,365,700 | 12/1982 | Arimoto et al. | 194/DIG. 26 |
| 4,398,088 | 9/1983 | Hirose et al. | 235/379 |

*Primary Examiner*—Gene Z. Rubinson
*Assistant Examiner*—Robert G. Lev
*Attorney, Agent, or Firm*—Fleit, Jacobson, Cohn & Price

[57] ABSTRACT

An automatic money receiving and disbursing machine having the functions of receiving money from customers and disbursing money to customers from a box disposed within the machine. The machine is provided with a circulation path in communication with a transacting section to receive or disburse the notes therethrough. A portion of the circulation path is in communication with the disbursing box for receiving the notes disbursed from the disbursing box. Another portion of the circulation path is in communication with a note receiving box. A discrimination section is provided in the circulation path to discriminate the notes received or the notes disbursed. In the disbursing mode, when an abnormal note is found by discrimination, all the notes are discriminated again by passing the notes through the discrimination section via the circulation path.

7 Claims, 1 Drawing Figure

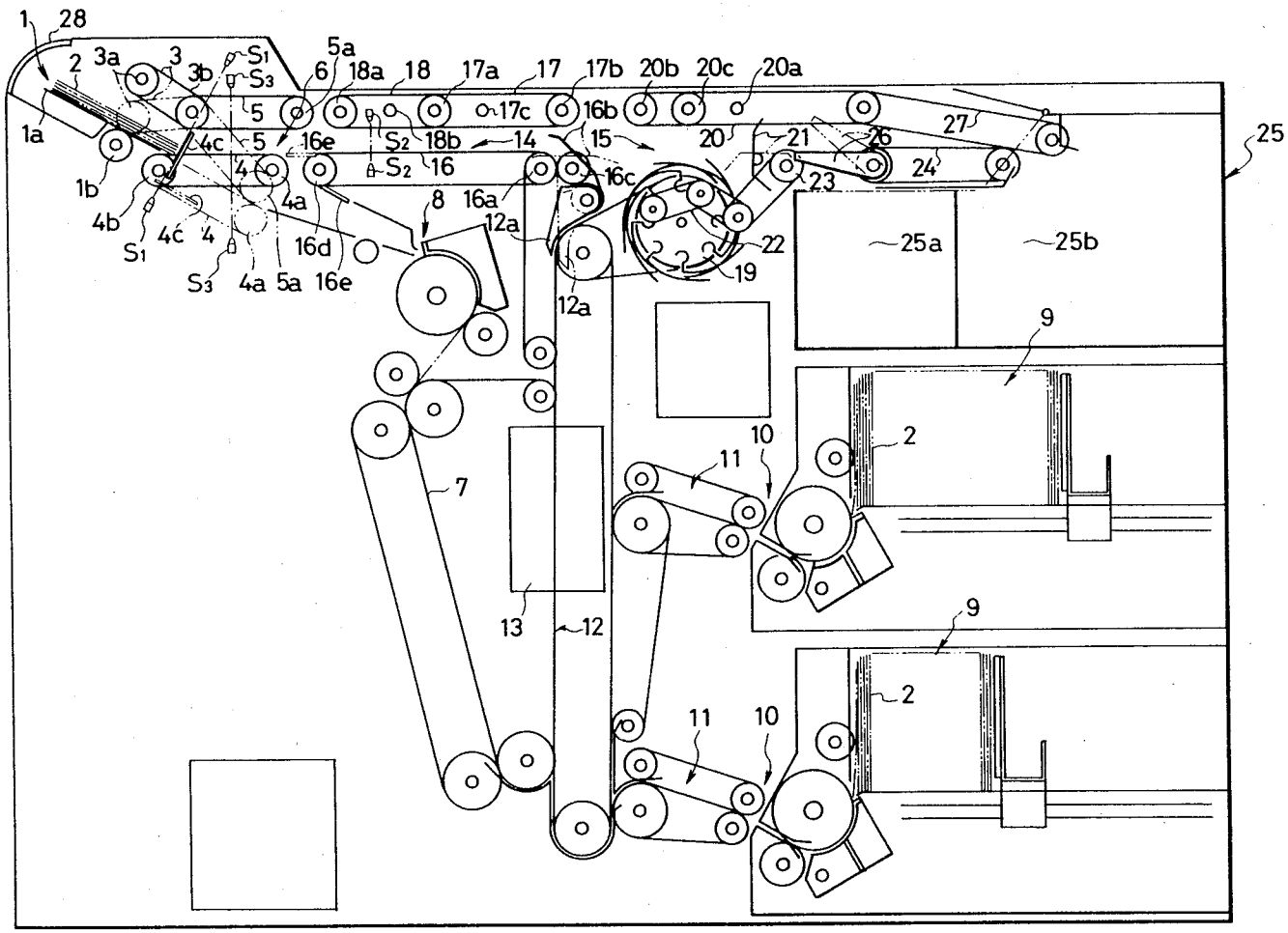
25
25b
9
27
24
25a
26
23
21
22
19
20a
20c
20
20b
17b
16b
15
16c
17
17c
14
12a
17a
18b
16
16a
8
18
S2
S2
12a
18a
5a
6
16e
16d
16e
4a
5a
S1
S3
5
5
4
4a
S3
3b
4c
4
4c
3
S1
3a
4b
1b
2
28
1
1a
2
2
10
10
11
11
12
13
7

AUTOMATIC MONEY RECEIVING AND DISBURSING MACHINE

BACKGROUND OF THE INVENTION

The present invention relates to an automatic money receiving and disbursing machine.

A conventional automatic money receiving and disbursing machine comprises a money receiving unit for effecting discrimination of notes charged in a transacting section and receiving notes judged as being true notes while returning notes judged as being not true notes and a disbursing unit for disbursing notes stored in a disbursing box according to need. This disbursing unit performs the functions of detecting the incorporation of different kinds of notes in notes disbursed from the disbursing box and the double feeding of notes, storing the notes temporarily, disbursing the stored notes if disorder is not detected until a predetermined number of notes are stored. In the meanwhile, if an abnormal note is detected before a predetermined number of notes are stored, the abnormal note together with the temporarily stored notes are rejected into a rejection box and the disbursing operation is again started.

However, in the above-mentioned disbursing operation, detection of disorder mostly happens when double feeding of normal notes is caused, and if the discharging and re-disbursing operations are repeated, the notes stored in the disbursing box are excessively used and supplementing fresh notes to the disbursing box becomes necessary, resulting in reduction of the operation efficiency of the machine. Moreover, a delivery apparatus for the money receiving unit and a container unit for containing received notes should be available for the automatic money receiving and disbursing machine. If a large disbursing box is arranged to cope with the above-mentioned detection of disorder at the disbursing operation, the size of the automatic money receiving and disbursing machine would inevitably be increased.

SUMMARY OF THE INVENTION

The present invention eliminates the foregoing disadvantages. More specifically, it is a primary object of the present invention to provide an automatic money receiving and disbursing machine in which the foregoing problems involved in the conventional machine are solved by feeding the note judged as being not normal and the notes stored before detection of disorder to a transacting section through a paid money transfer passage and feeding them to a received money transfer passage from the transacting section to effect discrimination again.

In accordance with the present invention, there is provided an automatic note receiving and disbursing machine which comprises, a transacting section for receiving the notes therein and disbursing the notes therefrom, a discriminating section for discriminating the notes, a first transfer passage for transferring the notes from the transacting section to the discriminating section and extending therethrough, at least one disbursing box for storing the notes to be disbursed, at least one second transfer passage for transferring the notes from the disbursing box to the first transfer passage, a note containing box for receiving the notes therein, a third transfer passage for transferring the notes from the first transfer passage to the note containing box, and a fourth transfer passage for transferring the notes from the first transfer passage to the transacting section.

DESCRIPTION OF THE DRAWING

The present invention will now be discribed in detail by reference to the embodiment illustrated in the accompanying drawing.

The drawing is a side view showing a structure of an automatic money receiving and disbursing machine according to the present invention.

DESCRIPTION OF THE PREFERRED EMBODIMENT

One embodiment of the present invention will be described in detail with reference to the accompanying drawing. In the drawing, reference numeral 1 represents a transacting section connected to the outside of the machine to perform money receiving, disbursing and returning operations. In the transacting section 1, a bottom plate 1*a* on which notes 2 are placed is arranged, and a feed roller 1*b* is disposed below the bottom plate 1*a* to feed out the note 2 on the bottom plate 1*a*. A pressing belt 3 is arranged above the feed roller 1*b* to grip the note 2 between the feed roller 1*b* and the pressing belt 3. A belt roller 3*a* is mounted on one end of the pressing belt 3. The belt 3 is also rotatable about a belt roller 3*b* on the other end of the belt 3, the roller 3*b* being vertically movable. A lower delivery belt 4 is disposed in the rear of the bottom plate 1*a* to deliver the note 2 fed out by the feed roller 1*b* and the pressing belt 3. A belt roller 4*a* is positioned on one end of the lower delivery belt 4. The belt 4 is also rotatable about the other belt roller 4*b* disposed adjacently to the lower end portion of the bottom plate 1*b* and is vertically movable. A stopper 4*c* is rotatably supported on the belt roller 4*b* to prevent the note 2 placed on the bottom plate 1*a* from slipping downward. Photo-sensors S1, S1, are arranged below and above the stopper 4*c* to detect the passage of the note 2. An upper delivery belt 5 is wound on the belt roller 3*b*, and the upper delivery belt 5 is rotatable about the belt roller 3*b* to be vertically moved so that the notes are held between the upper and lower delivery belts 4 and 5. A delivery and discharge unit 6 is constructed by the pressing belt 3 and the upper and lower delivery belts 4 and 5. In the rear of the lower delivery belt 4 of the delivery and discharge unit 6, a feeding section 8 is arranged to separate notes 2 from one another and feed them one by one to a received money transfer passage 7.

Reference numeral 9 represents a disbursing box, and notes stored in the disbursing boxes 9 are fed one by one to disbursing transfer passages 11 through feeding sections 19.

Notes 2 fed from the received money and disbursing transfer passages 7 and 11 are delivered through a discriminating transfer passage 12 extending upward in the drawings, and a discriminating unit 13 is arranged astride the discriminating transfer passage 12 to detect incorporation of different kinds of notes, double feeding and incorporation of forged notes. In the outlet portion of the discriminating transfer passage 12, there is disposed a gate 12*a* for switching the direction of feeding of notes 2 to a paid money transfer passage 14 for feeding notes to the delivery and discharge unit 6 or to a pool section 15 in which the notes 2 are temporarily stored.

The paid money transfer passage 14 comprises a lower belt 16 and upper belts 17 and 18. The notes 2 are fed between a belt roller 16*a* and a feed roller 16*c*. A guide plate 16*b* for pressing the top ends of the fed notes 2 and charging the top ends of the fed notes in the horizontal direction is rotatably supported on the feed roller 16*c* on the inlet side of the lower belt 16. A guide plate 16*e* for guiding the note 2 to the upper delivery belt 5 of the delivery and discharge unit 6 is rotatably supported on a belt roller 16*d* on the outlet side of the lower belt 16. Belt rollers 17*a* and 17*b* of the upper belt 17 are rotatably supported about a pin 17*c* and a belt roller 18*a* is rotatably supported about a pin 18*b*.

The pool section 15 is formed between an accumulating wheel 19 and an upper belt 20 arranged above the accumulating wheel 19. Notes 2 from the accumulating wheel 19 are piled up from the lower side on the upper belt 20 wound on belt rollers 20*b* and 20*c* rotatably supported about a pin 20*a* to be vertically movable. At the time, the end portions of the notes 2 fall in abutting contact with a gathering plate 21 in the state shown by solid lines in the drawings. A lower belt 22 is arranged on both the sides of the accumulating wheel 19, and this lower belt 22 is rotatable about a feed roller 23 to be vertically moves so as to hold the note 2 between the upper and lower belts 20 and 22. A lower feed belt 24 is arranged in the rear of the lower belt 22, and first and second containing section 25*a* and 25*b* of a note containing box 25 are opened below both the ends of the lower feed belt 24. The notes 2 fed out from the lower belt 22 are distributed to the first containing section 25*a* or second containing section 25*b* for receiving the rejected notes or received notes by a gate 26 arranged between the feed roller 23 and the lower feed belt 24. The notes 2 delivered by the lower feed belt 24 are pressed to the lower feed belt 24 by a pressing belt 27 arranged above lower feed belt 24.

The money receiving operation in the automatic money receiving and disbursing machine having the above-mentioned structure will be described. When notes 2 are thrown into the transacting section 1, the notes 2 abut against the stopper 4*c* in the state indicated by solid lines in the drawings so as to be accommodated. The pressing belt 3 is brought down as indicated by two-dot chain lines in the drawings to hold the notes 2 between the pressing belt 3 and the feed roller 1*b*. Then, the stopper 4*c* is retreated as indicated by two-dot chain lines in the drawings and the notes 2 are fed onto the lower delivery belt 4 in the brought-down state as indicated by two-dot chain lines in the drawings. Then, the notes 2 on the lower delivery belt 4 are fed to the feeding section 8 while the notes 2 are pressed from above by the upper delivery belt 5 in the brought-down state as indicated by two-dot chain lines in the drawings. Then, the notes 2 are fed to the received money transfer passage 7 and are fed to the discriminating transfer passage 12 from the received money transfer passage 7 to effect discrimination in the discriminating section 13. When the notes 2 are judged as true notes, the notes 2 are guided by the gate 12*a* in the state shown by solid lines in the drawings and are fed into the pool section 15 and temporarily stored therein. When all the received notes are fed into the pool section 15, the upper and lower belts 20 and 22 are brought down and lifted up, respectively, to hold the notes 2 in the pool section 15. The notes 2 are fed and contained in the second containing zone 25*b* through the gate 26 in the state indicated by solid lines in the drawings. At the time, if the total sum of the notes temporarily stored in the pool section is not consistent with the sum indicated by the customer or for some other reason, the lower feed belt 24, or the upper and lower belts 20 and 22 are moved in the reverse direction to feed the notes 2 to the paid money transfer passage 14 and return them. When one of the notes 2 is detected as being not a true note, the gate 12*a* is turned to the state indicated by two-dot chain lines in the drawings and that note 2 is fed into the paid money transfer passage 14. In either case of returning or in case of detection of disorder, the notes 2 fed into the paid money delivery passage 14 and the pool section 15 are fed into the transacting section 1 in the following manner.

The lower delivery belt 4 is lifted up as indicated by solid lines in the drawings and the guide plate 16*e* is turned to the state indicated by two-dot chain lines in the drawings. Then, the notes 2 are delivered in the state held between the lower belt 16 and the upper belts 17 and 18 and are fed into the delivery and discharge unit 6. On detection of the passage of the notes 2 by the photo-sensors $S_2$, the upper delivery belt 5 is brought down by one stage and the notes 2 are delivered in the state held between the upper delivery belt 5 and the lower delivery belt 4. On detection of the passage of the note 2 by the photo-sensors $S_3$, the pressing belt 3 is turned and brought down, and the note 2 is fed onto the bottom plate 1*a* of the transacting section 1 in the state held between the pressing belt 3 and the feed roller 1*b*. When feeding of the note 2 onto the bottom plate 1*a* is detected by the photo-sensors $S_1$, the stopper 4*c* is turned and elevated to the position indicated by solid lines in the drawings to prevent slipping of the note 2. Thus, the returning operation is completed. After the notes 2 are contained in the second containing zone 25*b* or returned to the transacting section 1, the pressing belt 3 and upper delivery belt 5 are lifted up as indicated by solid lines in the drawings and the lower delivery belt 4 is brought down in the state shown by solid lines in the drawings. Thus, the next money receiving or disbursing operation is now ready.

A shutter 28 is arranged in the transacting section 1 so that it is opened only when received and paid notes are thrown and taken out.

The disbursing operation will now be described. The notes 2 stored in the disbursing box 9 are fed one by one to the received money transfer passages 11 through the feeding section 10 and are fed to the discriminating transfer passage 12 from the received money transfer passages 11. The notes 2 are thus delivered while they are being discriminated, and are guided by the gate 12*a* in the state indicated by solid lines in the drawings and are fed into the pool section 15 and temporarily stored therein. When a predetermined number of notes are stored without detection of disorder, the notes 2 are held between the upper and lower belts 20 and 22 and fed into the paid money transfer passage 14 through the guide plate 16 kept in the horizontal state as indicated by two-dot chain lines in the drawings. Then, the delivery and discharge unit 6 performs the same operation as in case of the above-mentioned return of paid notes. That is, the notes 2 are fed into the transacting section 1 and are supported by the stopper 4*c* in the state indicated by solid lines in the drawings. Thus, the disbursing operation is completed. When disorder is detected before a predetermined number of notes 2 are stored in the pool section 15, the feeding section 10 is stopped to temporarily stop feeding of the notes 2. After all the notes 2 which are present in the discriminating transfer passage 12 are fed into the pool section 15, the notes 2 in the pool section 15 are held between the upper and lower belts 20 and 22 and fed into the paid note transfer passage 14. The delivery and discharge unit 6 is operated in the same manner as in case of the above-mentioned return of received notes to feed the notes 2 to the transacting section 1. After detecting of the rear end of the note 2 by the photo-sensors $S_1$, the upper and lower delivery belts 4 and 5 are brought down as indicated by two-dot chain lines and are moved in the reverse direction to feed the note 2 to the feeding section 8. Then, discrimination is conducted again while the notes 2 are delivered on the discriminating transfer passage 12 through the received money transfer passage 7, and the notes 2 are temporarily stored in the pool section 15. When rediscrimination is completed without detection of disorder, notes 2 are fed from the disbursing boxes 9 until a predetermined number of notes are stored in the pool section 15. If a predetermined number of notes are stored without detection of disorder, the disbursing operation is carried out in the same manner as described above. When disorder is detected during the re-discriminating operation, after all the notes discriminated again are fed into the pool section 15, the notes in the pool section 15 are held between the upper and lower belts 20 and 22 and discharged into the first containing section 25*a* of the note containing box 25. Notes 2 are fed out from the disbursing boxes 9 again and the disbursing operation is conducted again. After the disbursing operation is completed, the lower delivery belt 4 is brought down as indicated by solid lines in the drawings and the pressing belt 3 and upper delivery belt 5 are elevated as indicated by solid lines. Thus, the next money receiving or disbursing operation is now ready.

In the foregoing embodiment, re-discrimination is conducted once and when disorder is detected during this re-discrimination, notes are discharged. This re-discrimination may be conducted two or more times. In the foregoing embodiment, when disorder is detected, the disbursing operation is once stopped and re-discrimination is carried out. In the present invention, there may be adopted a modification in which notes are stored in the pool section until a predetermined number of notes are stored in the pool section, the notes are re-discriminated and when disorder is not detected, the notes are disbursed or when disorder is detected, the notes are discharged.

As will be apparent from the foregoing description, in an automatic money receiving and disbursing machine, there is disposed a delivery and discharge unit for feeding notes fed from the paid money transfer passage to the transacting section and feeding notes in the transacting section into a received money transfer passage through the feeding section, so that the note detected as being not normal during the disbursing operation is fed into the transacting section through the paid money transfer passage to effect discrimination again. Accordingly, when disorder such as double feeding takes place in notes fed out from the disbursing boxes, the feeding operation is conducted again to eliminate disorder and the discrimination is conducted again, so that the notes discriminated again can be disbursed. Therefore, the frequency of the discharge of paid notes to be conducted because of double feeding which often occurs can be reduced and hence, the frequency of supplement of notes can be reduced, with the result that the operation efficiency can be increased.

What is claimed is:

1. An automatic note receiving and disbursing machine having a receiving mode where notes are received therein and a disbursing mode where notes are disbursed therefrom, said machine comprising:

a transacting section for receiving and disbursing notes;

a first transfer passage for transferring notes;

a discriminating means located in the first transfer passage for making a first discrimination and determining whether notes passing through the first transfer passage are normal;

a second transfer passage positioned downstream from the transacting section and upstream from the first transfer passage for transferring notes from the transacting section to the first transfer passage;

a disbursing means for storing notes to be disbursed;

at least one third transfer passage located downstream from the disbursing means and upstream from the first transfer passage for transferring notes from the disbursing means to the first transfer passage;

a storage means located downstream from the first transfer passage for receiving and temporarily storing notes from the first transfer passage;

a note holding means located downstream from the storage means for receiving notes from the storage means;

a fourth transfer passage located downstream from the first transfer passage and adjacent to the storage means, said fourth transfer passage being in communication with the transacting section for transferring notes selectively from one of the first transfer passage and the storage means to the transacting section;

a circulation path defined by the fourth transfer passage, the second transfer passage, the first transfer passage and the storage means;

first means for transferring notes received from the transacting section through the second transfer passage, the first transfer passage, and the storage means to the note holding means and then storing said notes in the note holding means during the receiving mode;

second means for transferring notes from the disbursing means through the third passage, the first transfer passage and the fourth transfer passage and then discharging said notes from the transacting section during the disbursing mode; and means for making a second discrimination of notes by passing notes through said discriminating means again in the circulation path when notes are judged to include abnormal notes during the disbursing mode.

2. A machine according to claim 1, wherein said means for making a second discrimination of notes makes the second discrimination of notes when an abnormal note is found in notes disbursed.

3. A machine according to claim 1, wherein said means for making a second discrimination of notes makes the second discrimination of notes when all notes disbursed are discriminated and an abnormal note is included therein.

4. A machine according to claim 1, further comprising a change-over transfer passage for changing transfer of notes received from the fourth transfer passage to one of the transacting section and the second transfer passage.

5. A machine according to claim 1, further comprising a gate means for changing over transfer of notes from the first transfer passage to one of the storage means and the fourth transfer passage.

6. A machine according to claim 1, wherein the note holding means comprises a first containing section for storing received notes therein and a second containing section for storing rejected notes therein.

7. A machine according to claim 1, further comprising a fifth transfer passage located between the storage means and the note holding means.

* * * * *